United States Patent [19]

Aubert

[11] Patent Number: 4,468,168

[45] Date of Patent: Aug. 28, 1984

[54] AIR-COOLED ANNULAR FRICTION AND SEAL DEVICE FOR TURBINE OR COMPRESSOR IMPELLER BLADE SYSTEM

[75] Inventor: Christian B. Aubert, Chartrettes, France

[73] Assignee: S.N.E.C.M.A., Paris, France

[21] Appl. No.: 442,188

[22] Filed: Nov. 16, 1982

[30] Foreign Application Priority Data

Nov. 16, 1981 [FR] France ..... 81 21353

[51] Int. Cl.[3] ..... F01D 11/08

[52] U.S. Cl. ..... 415/116; 415/174; 415/175; 415/178; 415/180

[58] Field of Search ..... 415/116, 174, 175, 177, 415/178, 180, 196

[56] References Cited

U.S. PATENT DOCUMENTS

| | | | |
|---|---|---|---|
| 3,213,789 | 10/1956 | Carswell | 415/180 |
| 3,425,665 | 2/1969 | Lingwood | 415/59 |
| 3,719,365 | 3/1973 | Emmerson | 415/174 |
| 3,825,364 | 7/1974 | Halila | 415/116 |
| 3,893,786 | 7/1975 | Rahnke et al. | 415/116 |
| 3,970,319 | 7/1976 | Carroll et al. | 415/174 |
| 4,130,373 | 12/1978 | Giles | 415/116 |
| 4,222,706 | 9/1980 | Ayache et al. | 415/116 |
| 4,392,656 | 7/1983 | Tirole et al. | 415/174 |

FOREIGN PATENT DOCUMENTS

| | | |
|---|---|---|
| 2393994 | 3/1980 | France . |
| 2468741 | 5/1981 | France . |
| 1308771 | 3/1973 | United Kingdom . |
| 2062115 | 5/1981 | United Kingdom . |

*Primary Examiner*—John W. Shepperd
*Assistant Examiner*—Renee S. Kidorf
*Attorney, Agent, or Firm*—Oblon, Fisher, Spivak, McClelland & Maier

[57] ABSTRACT

An annular friction seal device to be disposed around the impeller of a turbine or high pressure compressor is disclosed. The turbine or compressor is of the type comprising, from the periphery inward, a support-ring surrounding the impeller, a first air-permeable annular layer fastened to the support-ring, and a second annular layer joined to the first layer and coming into immediate proximity with the impeller blade ends, and being abaradable by these ends. To simplify production of the annular seal device, it is provided with two annular layers provided within a single superalloy seal ring with channels bored through the entire seal ring. The channels are open to air in one zone and are closed in at least the upstream end of the other zone.

13 Claims, 4 Drawing Figures

AIR-COOLED ANNULAR FRICTION AND SEAL DEVICE FOR TURBINE OR COMPRESSOR IMPELLER BLADE SYSTEM

BACKGROUND OF THE INVENTION

1. Field of the Invention

The invention relates to annular friction and seal devices to be placed around the impeller blades of a gas turbine or high pressure axial compressor stage. For example, in a stator-and-rotor machine, around the impeller blade system defining the hot gas stream. More specifically, it concerns such a device in association with means for cooling the friction seal and protecting the stator from the heat of the gases in the stream. The device is of the type which comprises successively from periphery to center: a support-ring surrounding the impeller, a first annular, air-permeable layer of material called the "cooling layer" fastened to the support ring, a second annular layer of material called the "friction layer" which is joined to the cooling layer, lies in immediate proximity to the ends of the impeller blades, and can be abraded by these blade ends, and a system for bringing cool air into the cooling layer.

2. Description of the Prior Art

The friction layer usually consists of a porous material (aggregate, felt, foam, perforated plate, etc.) that can be abraded by the ends of the blades. Unless some special arrangement is made, the cooling air passes through this layer and flows at least in part toward the hot gas stream.

The U.S. Pat. No. 4,392,656 Tirole, et al describes a device of this type in which the two annular layers are separated by a middle layer, the permeability of which is such that the radial flow of air which crosses the middle layer is appreciably less than the flow of axial air that crosses the cooling layer.

The middle layer may even be impermeable to air so that the air flows only axially (i.e., in a direction parallel to the axis of the machine) in the cooling layer. All direct interaction between the two layers is eliminated. The friction layer is cooled by thermal conduction toward the cooling layer. This arrangement, intended to keep to seal function of the friction layer independent from the cooling function of the cooling layer (which also protects the support-ring from the heat of the gas stream), makes it possilbe to eliminate the disadvantages inherent in cooled annular friction seal means that are traversed by all or a large part of the flow of cooling air. These disadvantages include the necessity of introducing the cooling air at a pressure appreciably higher than the pressure in the gas stream, the existence within the cooling layer of an axial flow that more or less opposes the radial flow, and the gradual loss of cooling efficiency as the friction zone grows less permeable, which occurs as a result of contamination of the layer by the gases in the stream and "pasting up" of the pores in the surface in contact with the ends of the blade.

SUMMARY OF THE INVENTION

The invention at hand has the advantages of the prior art, avoids the disadvantages of the prior art, and does so with a simpler structure that is easier to produce.

The invention is of the above type, comprising the support-ring, cooling layer, and friction layer, but these two layers are provided in a single seal ring (as distinguished from the support-ring) affixed to the inside of the support ring and made of a metal alloy that is refractory under the conditions of use (i.e., one capable of resisting the mechanical, thermal, and chemical stresses caused by the gases in the stream), with the seal ring being traversed from end to end by a plurality of channels running parallel to the surface generated by the revolutions of the blade ends and occupying the entire crosssectional area of said seal ring. Said channels open onto the two lateral surfaces of the seal ring and are in one zone traversed by cooling air, within the annular zone forming the cooling layer, and in another zone closed at least at the upstream end in the annular zone forming the friction layer. In the second zone, the channels form closed cavities that serve to reduce the heat conduction of the zone while increasing its abradability. The latter quality is considerably improved if the channels are produced using a boring process (laser or electron bombardment) capable of causing numerous micro-cracks to appear in the channel walls due to thermal shock, so that the friction zone becomes friable under the abrasive action of the blade ends.

Through very simple means, therefore, the invention makes possible a rigorous separation of the functions of the two zones. The radial heat gradient in the cooling zone is very low since its channels are cooled. On the other hand, this gradient is very high in the friction zone and causes differential expansions which encourage the propagation of the proto-breaks, or micro-cracks.

Since the seal ring is advantageously brazed onto the support ring and must be of a refractory material, there are reasons for using a superalloy for its construction, i.e., an alloy containing more than 50% nickel and/or cobalt by weight. The boring process most likely to produce micro-cracks in such material is electron bombardment. As the hole which is to form the channel progresses, this method produces intense localized heating followed by quick cooling through diffusion of heat through the ring's mass. Electron bombardment boring materials of the type described in the French Pat. No. 2, 393,994 may be used.

The maximum width of the seal ring obviously depends on the size of the engine. It is commonly 40 mm or more which, in certain cases, exceeds the maximum boring depth possible with electron bombardment, at least with those machines presently in use. When the ring exceeds the maximum boring thickness, one of the following embodiments of the invention may be used:

1. In one solution, the ring may consist of a stack of the necessary number of identical elementary rings, whose channels must be carefully aligned during assembly.

2. In a second solution, means are used which consist of the necessary number of elementary rings, each of which is in conformity with the teachings of the invention and thus comprises a support-ring and a seal ring.

It will be seen that the second solution is more advantageous because it allows for the best adjustment of the flow of cooling air by crossing "in parallel" the various elementary rings making up the seal ring.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

All of the parts in the Figures can revolve, so they may be shown by axial and diametrical cross-sections. The arrows show the direction of flow of the cooling air.

Figure 1:
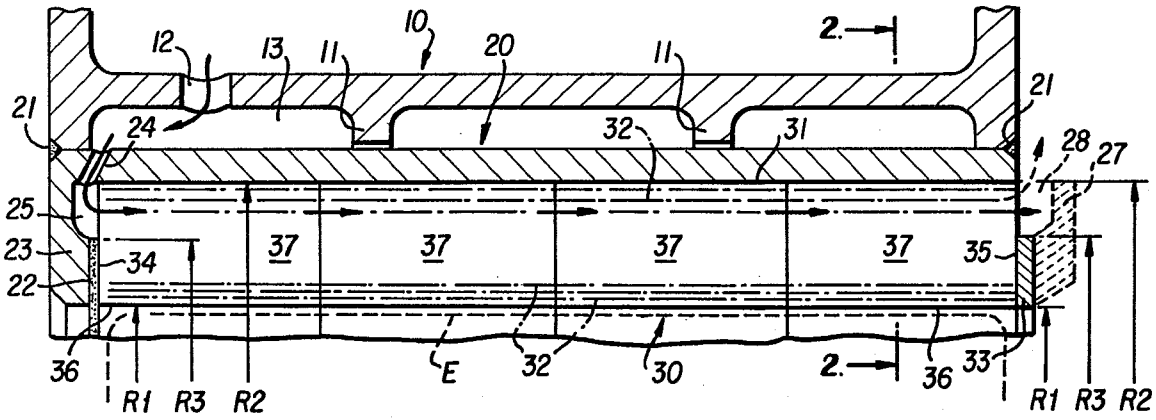
FIG. 1 is an axial cross-section of a first embodiment of a seal device conforming to the invention.

FIG. 1 will now be described. Turbine ring 10 surrounding the turbine impeller (of which one sees end E of a blade shown in dashed lines) may be inserted between an outer distributor sleeve of the turbine stage at hand and, if necessary, an outer distributor sleeve of the following stage.

The cooled seal device includes a support-ring generally shown as 20 and a seal ring generally shown as 30. Support-ring 20 is fastened at its ends to turbine ring 10 by means of circular beads of solder 21 and may also be centered by means of ribs 11.

Figure 2:
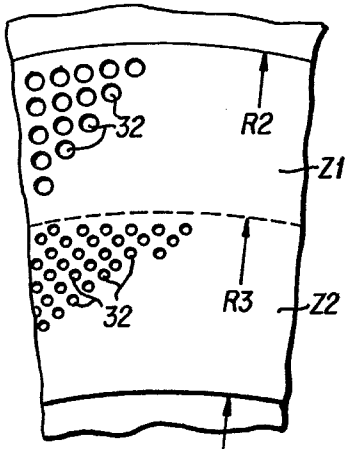
FIG. 2 is a partial cross-section in larger scale, in plane 2—2 of FIG. 1.

Seal ring 30 is housed within support-ring 20, to which its radially outer periphery 31 is brazed. It is crossed by a plurality of parallel axial channels 32 which are shown in dashed-and-dotted lines in FIG. 1 and in cross-section in FIG. 2. These occupy the entire cross-section of seal ring 30.

An annular bearing surface 22 forming part of upstream flange 23 of support ring 20 is brazed onto the upstream axial surface 34 of seal ring 30 while a ring 33 may be brazed onto the downstream axial surface 35 of the same seal ring 30. The radially inner circumference of the bearing surface and ring are flush with the inner contour 36 of ring 30, along radius R1, while their radially outer circumferences have equal radii R3 which are substantially smaller than radius R2 of radially outer surface 31. Said bearing surface 34 and said ring 33 thus form screens which divide ring 30 into two concentric annular zones, i.e., an outer zone Z1 with outer radius R2 and an inner radius R3, and an inner annular zone Z2 with outer radius R3 and inner radius R1. These screens transform the channels 32 lying in zone Z2 into cavities that are closed, or, if ring 33 has not been used, semi-open.

A flow of air obtained by deviation of a fraction of the flow of the compressor supplying the turbine first enters the device through a plurality of openings 12 provided in ring 10 and into annular chamber 13 which surrounds the upstream portion of support-ring 20. The air flow then moves through openings 24 in support-ring 20 and into an annular chamber 25 defined by the upstream surface of seal ring 30 and recessed portion of flange 23. The air flow is then blown into channels 32 of zone Z1 and exits through the downstream surface of that zone. The ring 30 consists of an axial stack of elementary rings 37, each identically bored with channels 32 and mounted so that channels 32 are in perfect alignment.

It can thus be seen that friction zone Z2, the channels of which form closed cavities, acts as a heat insulator, and zone Z2 thus has a high radial temperature gradient during operation. Zone Z1, on the other hand, has air passing through its channels, forming a heat exchanger which removes heat coming from zone Z2. These two zones thus form a double heat screen which effectively protects support ring 20 and turbine ring 10.

As specific features of the embodiment of FIG. 1, the stacking of elementary rings 37 must be done very meticulously, given the small diameter of the channel sections to be aligned. Moreover, the flow of air is limited by the total sectional area of openings 24 and by the length of the channels, which cause pressure losses.

Figure 3:
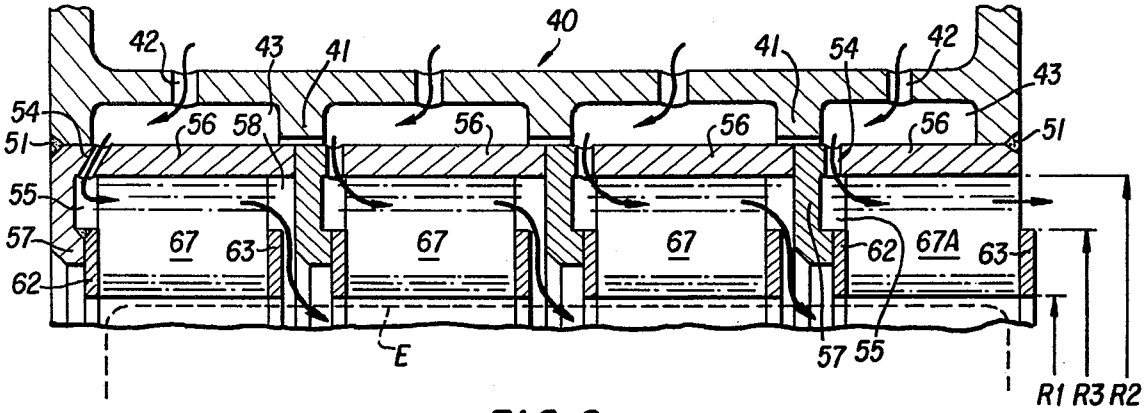
FIG. 3 is an axial cross-section of a second embodiment of a seal device conforming to the invention.

FIG. 3 shows an embodiment which makes it possible to eliminate these limitations. The refractory friction ring is here divided into short elementary rings 67, each of which is provided with its own system for supply of cooling air.

Turbine ring 40 is provided with as many rows of air passage openings 42 as there are elementary rings 67. The support-ring is divided into the same number of support elements 56, each of which houses an elementary ring 67 which is brazed in place along its radially outer periphery. Each element 56 is equipped with an inner upstream flange 57 against which a corresponding elementary ring abuts and which is shaped so as to provide an annular chamber 55 opposite zone Z1 (see FIG. 2). With the exception of the last element downstream (67A), each elementary ring 67 is shorter than the housing reserved for it in corresponding support element 56, which creates a space 58 between the downstream end of the elementary rings and the following flange 57. The channels of zone Z2 of each elementary ring are closed off by means of annular screen 62 brazed onto the upstream end of each ring. An annular screen 63 may also be brazed onto the downstream end of each ring. Lastly, the rows of openings 42 are separated by ribs 41, each of which supports the downstream end of one element 56 and the upstream end of the following element, and which define annular chambers 43. Each of these chambers 43 is supplied with air by the corresponding row of openings 42 and communicates with the corresponding annular chamber 55 through a row of openings 54 provided in the corresponding element 56. Two annular beads of solder 51 fasten the stack of support elements 56 flush with the upstream end and downstream end of turbine ring 40.

The seal device of FIG. 3 thus consists of a stack of elementary sections, which together conform to FIG. 1 and which are short enough so that their seal rings 67 act as a single ring. This arrangement further provides a much greater flow of cooling air than the arrangement of FIG. 1 at the same supply pressure, since the number of intake openings and circulation channels is much higher, while at the same time the channels are much shorter. Conversely, the air pressure needed to obtain an equal supply of air is much lower. It should also be noted that with the exception of left seal element 67, each seal element has its inner contour cooled by the film of air delivered by preceding annular chamber 58.

Lastly, it is possible, if necessary, to divide each seal ring 67 into a stack of at least two elementary rings.

Figure 4:
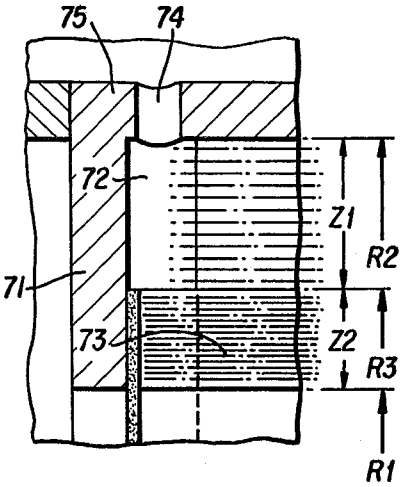
FIG. 4 is a partial longitudinal section of a variant of the embodiments in FIGS. 1 and 3.

FIG. 4 illustrates a variant of the air intake chamber 72 for the channels of zone Z1 (25 in FIG. 1; 55 in FIG. 3). Annular flange 71 (equivalent to flanges 23 and 57 of FIGS. 1 and 3) is flat. Air intake chamber 72 is formed by shortening part of seal ring 73 so as to obtain an annular chamber limited by radii R2 and R3 (zone Z1) and is supplied with cooling air through openings 74 bored into seal ring support 75. The unshortened part (zone Z2) of ring 73 is brazed onto flange 71, which plays the twin role of bearing and cap. Another variant will now be described, relating to the method of exhausting air which has passed through the channels of zone Z1. Although this description refers to FIG. 1, it applies equally to the seal device of FIG. 3. According to what has been said so far about the device of FIG. 1, the cooling air escapes into the gas stream. However, it is possible to cause it to escape outside the stream, exhausting it into the atmosphere. This possibility is illustrated by a flange 27 (shown in dashed lines) brazed onto the downstream end of ring 30 in zone Z2, while providing an annular exhaust chamber 28 in zone Z1. The path of the cooling air is thereby completely isolated from the stream of hot gases. This variant may be of great value, particularly if the stage in question belongs to a high pressure compressor, since it makes it possible to draw off an air flow from a low pressure stage to cool the high pressure stage, which would be impossible if the flow were to return into the high pressure stream since there would be an inversion of the direction of the (compressor) flow.

Finally, there will be described an example of a specific seal device of the invention. If the operating temperatures of the machine are high, the support-ring 20 and seal ring 30 should be made from a superalloy, particularly an easily welded and machined product such as a superalloy of the NC22FeD range.

Since the functions of channels 32 of zones Z1 and Z2 are different, they may have different diameters and even different relative arrangements. In (cooling) zone Z1, the diameter and pitch of the channels depend on the air supply pressure, on the pressure to be overcome in the stream (if the air is to spill into the stream), and on the flow necessary to obtain effective cooling. However, the diameter must not fall below a certain value in order to limit pressure losses and blockage by dust. Channels 32 in zone Z1 could be fashioned, for example, with a diameter of 1 mm and a pitch of 1.5 mm. In zone Z2, the friction zone, the channels 32 must be as close together as possible and of small diameter. The channels must be distributed preferentially in a staggered pattern in order to improve their abradability by the ends of the blades, in case of contact, and to ensure an adequate and homogenous radial temperature gradient. For example, channels of a diameter of 0.3 mm could be provided in this zone, disposed in circular rows, with the pitch of the channels in each row being 0.4 mm and the rows being offset from one another by a half-pitch, so that any given channel will be equidistant from all adjacent channels. It should also be noted that the blocking of the channels of zone Z2 may be done by simple application of solder, rather than by means of a flange or screen.

It is clear that the scope of the invention would not be exceeded if seal ring 30 (or stack of seals 67) were cone shaped (instead of cylindrical) in cases in which the motion of the blade ends generate a conic surface rather than a cylindrical one, such as that illustrated in the attached drawings. Of course, in such a case, the direction of channels 32 would have to be parallel to the generatrixes of the cone instead of being parallel to the axis of the impeller.

Obviously, numerous modifications and variations of the present invention are possible in light of the above teachings. It is therefore to be understood that within the scope of the appended claims, the invention may be practiced othewise than as specifically described herein.

What is claimed as new and desired to be secured by letters patent of the United States is:

1. An air cooled annular friction and seal structure for the blades of a machine having a stator and rotor in a stream of gases, said structure comprising:

a support ring radially surrounding said blades;

an axial stack of at least one seal ring fixed to the radially inner surface of said support ring and in closely facing relation to said blades, each said seal ring being formed of a metal superalloy which is refractory under conditions of use;

a plurality of axial channels extending entirely through the entire cross-section area of said stack of seal rings between an upstream end and a downstream end thereof, said channels extending parallel to a surface generated by the rotation of said blades;

means for closing at least the upstream end of a radially inner portion of said stack; and means for introducing cooling air to the upstream end of a radially outer portion of said stack, whereby said channels of said radially inner zone form closed cavities which reduce the thermal conductivity, and increase the abradability, of said radially inner zone, wherein said means for introducing cooling air comprises:

a flange of said support ring extending radially inward adjacent said upstream end of said stack; and an annular recess in one of said stack and said flange, said recess positioned to face said channels of said radially outer portion of said stack.

2. The structure of claim 1, wherein the material of said seal ring is selected from the group consisting of a nickel and cobalt-based superalloy, wherein said channels are machined by a process that causes micro-cracks to appear in the walls of said channels.

3. The structure of claim 1, wherein said process uses lasers or electron bombardment.

4. The structure of claim 1 wherein said recess is in said flange.

5. The structure of claim 1 wherein said recess is in said stack.

6. The structure of claim 1 wherein said means for closing comprises said flange.

7. The structure of claim 1 including means for evacuating out of said stream of gases, said air flow from said channels.

8. The structure according to claim 1, wherein said stack comprises at least two seal rings in each of which the arrangement of said channels is identical and which are oriented so that their channels are aligned.

9. The structure of claim 8, wherein said means for closing comprise a brazed annular metal screen.

10. The structure of claim 8, wherein said means for closing comprise a layer of brazing solder.

11. The structure of claim 1 including at least two assemblies of said support ring, said stack, said means for closing and said means for introducing, said at least two assemblies being axially mounted end to end.

12. The structure of claim 11 wherein said machine comprises a gas turbine machine.

13. The structure of claim 11 wherein said machine comprises a high pressure compressor.

* * * * *